United States Patent [19]

Schuette

[11] Patent Number: 4,527,370

[45] Date of Patent: Jul. 9, 1985

[54] MODULAR BUILDING

[76] Inventor: Heinz Schuette, 127 Connestee Trail, Brevard, N.C. 28712

[21] Appl. No.: 366,834

[22] Filed: Apr. 8, 1982

[51] Int. Cl.[3] ..... E04B 1/00

[52] U.S. Cl. ..... 52/282; 52/309.9; 52/584

[58] Field of Search ..... 52/282, 582, 580, 584, 52/285, 309.9, 309.8

[56] References Cited

U.S. PATENT DOCUMENTS

| | | | |
|---|---|---|---|
| 2,156,347 | 5/1939 | McLaughlin, Jr. | 52/282 X |
| 2,887,740 | 5/1959 | Potchen | 52/584 X |
| 3,045,293 | 7/1962 | Potchen | 52/309.8 |
| 3,203,147 | 8/1965 | Penley | 52/584 X |
| 3,324,831 | 6/1967 | St. Onge | 119/19 |
| 3,381,430 | 5/1968 | Wiczer | 52/282 |
| 3,432,196 | 3/1969 | Machiorello | 52/584 |
| 3,496,058 | 2/1970 | Schroter et al. | 52/309.8 X |
| 3,865,425 | 2/1975 | French | 296/24 C |
| 3,866,381 | 2/1975 | Eschbach et al. | 52/282 X |
| 4,373,312 | 2/1983 | Kim | 52/309.9 |

FOREIGN PATENT DOCUMENTS

| | | | |
|---|---|---|---|
| 1007650 | 10/1965 | United Kingdom | 52/282 |

*Primary Examiner*—Carl D. Friedman

*Attorney, Agent, or Firm*—Basile, Weintraub & Hanlon

[57] ABSTRACT

A modular building having walls and roof panels formed from insulating material with an outer surface of the walls covered with a metal sheeting is disclosed. The metal sheeting of the panels extends past the insulating material a distance and is formed into a joint. The joint co-operates with the joint of an adjacent wall to join panels into an assembly. The interior surface of the panels is a hardened plastic textured to resemble wood grain and formed by the contact of the injected plastic with the mold surface.

1 Claim, 11 Drawing Figures

MODULAR BUILDING

BACKGROUND OF THE INVENTION

I. Field of the Invention

The present invention generally relates to modular buildings and, in particular, the present invention is concerned with modular buildings formed from injection molded panels having a sheet metal exterior. Even more particularly the present invention is concerned with modular buildings formed from injection molded insulating material covered along an outside surface with a sheet metal covering, and an interlocking joint formed by an extending edge of the sheet metal covering.

II. Description of the Prior Art

Modular buildings of the type consisting of factory built walls and panels shipped to the building site to be assembled thereon are known. Generally, this type of modular building is constructed of factory cut plywood and studs that is nailed or bolted together at the site of the building. Generally, these buildings are not insulated and if insulation is desired it must be purchased and installed by the building owner. The insulation is generally rolled fiberglass bats that provide no structural support and require clips or other devices to hold them in place. Modular buildings having metal panels that are factory made and shipped to the building site for assembly are also known. These also require the separate addition of insulation after the building has been constructed. Examples of modular buildings in the prior art are disclosed in the U.S. Pat. Nos. 3,324,831; and 3,865,425. These patents are relevant to the applicant's invention in that they represent the closest prior art for modular building construction.

III. Prior Art Statement

The aforementioned prior art, in the opinion of the applicant and the applicant's attorney represents the closest prior art of which the applicant and his attorney are aware. None of the aforementioned patents disclosed a modular building constructed of panels formed from insulating material having a metal surface overlaying the exterior with an extending end of the sheeting formed into a joint for assembly to a cooperating adjacent panel.

SUMMARY OF THE INVENTION

The present invention, which will be described in greater detail hereinafter comprises a modular building having walls and roof panels formed from a rigid insulating material such as polyurethane foam. The exterior of the panels are covered with a durable decorative metallic skin such as aluminum which is roll formed or stamped in a press and given a surface appearance to resemble lapped siding for wall panels or a shingled texture for roof panels. Edges of the sheet metal exterior extend past the insulating panels a distance and are roll formed into an interlocking joint which allows the panel to be assembled to a co-operating adjacent panel forming and integral structure.

It is therefore an object of the present invention to provide a new and improved modular building.

It is a further object of the present invention to provide a modular building formed from insulating panels.

It is yet another object of the present invention to provide a modular building formed from insulating panels which have an exterior covered with decorative and durable metal sheeting.

It is a further object of the present invention to provide a modular building having panels with a metal exterior wherein edges of the metal covering are formed into an interlocking joint.

It is yet a further object of the present invention to provide a modular building formed from insulating panels with a metal exterior, with the exterior formed to resemble lapped siding.

It is yet another object of the present invention to provide an improved modular building formed from insulating panels covered with a metallic exterior wherein the roof panels are formed to resemble shingles.

Further objects, advantages, and applications of the present invention will become apparent to those skilled in the art of modular buildings when the accompanying description of the best mode contemplated for practicing the invention is read in conjunction with the accompanying drawing.

BRIEF DESCRIPTION OF THE DRAWING

The description herein makes reference to the accompanying drawing wherein like reference numbers refer to like parts throughout the various several views and wherein.

DESCRIPTION OF THE PREFERRED EMBODIMENT

Figure 2:
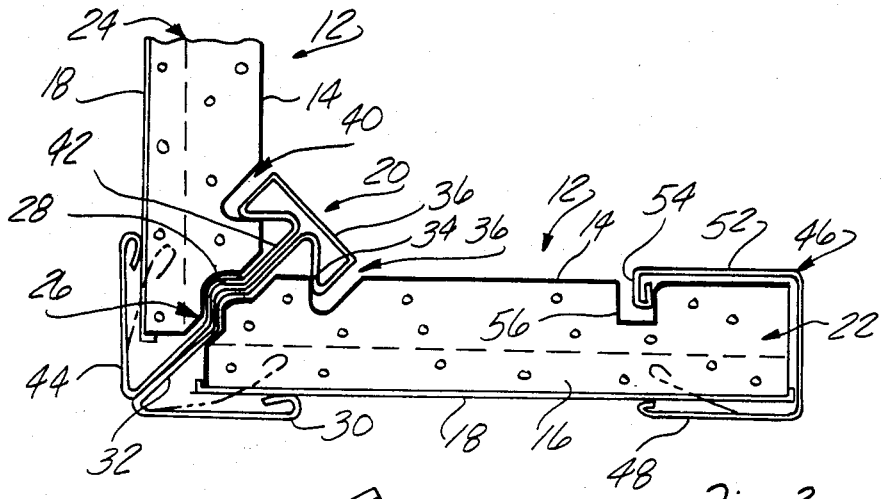
FIG. 2 illustrates a cross sectional view through section 2—2 of FIG. 1.
Figure 1:
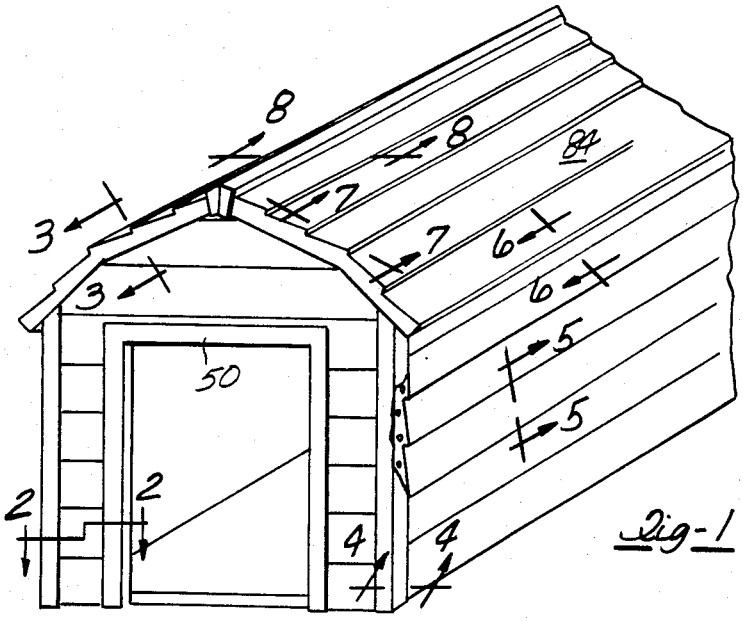
FIG. 1 illustrates a perspective view of the assembled modular building of the present invention.

Referring now to the drawing, there is illustrated in FIG. 1 an example of the present invention in the form of a modular building 10. The building 10 has walls, roof panels, and a floor made from insulating material. As shown in FIG. 2 of the drawing, which is a cross sectional view through a corner of the building, upright walls 12 include an inside surface 14 which is a durable hard plastic and is formed by the contact of a polyurethane foam 16 with the inside surface of the mold which forms the wall. The inside surface 14 is preferably textured to resemble a wood grain finish which gives the building a pleasing interior which is both decorative and durable. The outside of the buiiding is covered with metal sheeting 18 which protects the panels from the weather. The metal sheeting is painted to give a pleasing appearance, and in a preferred embodiment, the sheeting 18 is contoured to resemble lapped siding.

As shown in FIG. 2 of the drawing a corner clip 20 is provided for joining a first upright wall 22 with a second upright wall 24 at a corner. The upright walls 22,24 abut at the corner at a right angle along a 45 degree abutting edge 26. A tongue and groove joint 28 is formed along the abutting edge to lock the walls 22, 24 in position and make the joint weather proof.

The corner clip 20 comprises a first leg 30 abutting the first upright wall 22 and extending to the corner. A first inner leg 32 is formed by bending the first leg inward at the corner to abut the abutting edge 26. The first inner leg 32 passes over and abuts the tongue and groove joint 28 in a complimentary manner. The first inner leg 32 extends inward past the first upright wall 22 a distance and is then bent outward toward the first upright wall 22 and then is bent inward to form a first notch engaging extension 34. A first notch 35 is formed along the first upright wall 22 to snugly receive the first notch engaging extension 34. A cross over segment 36 is formed by bending an inner end of the first notch engaging invention 34 toward the second upright wall 24, and a second notch engaging extension 38 which is a mirror image of the first notch engaging extension 34 is formed by bending an end of the cross over segment 36 toward the corner than inward. A second notch 40 is formed along the second upright wall 24 to receive the second notch engaging extension 38. An inner end of the second notch engaging extension 40 is bent to extend outward forming a second inner leg 42 which abuts the first inner leg 32 extending outward along the abutting edge 26. An outer end of the second inner leg 42 is then bent toward the second upright wall 24 to form a second leg 44 abutting the second upright wall. The first leg 30 and the second leg 44 are biased inward toward the first and second upright walls 22, 24 respectively to hold the first and second walls in abutment along the abutting edge 26.

Still referring to FIG. 2 of the drawing, an opening molding 46 is provided to finish the edge of openings such as windows and doors. The molding 46 comprises an outer wall 48 abutting the metal sheeting 18, and edge covering wall 50 running along the exposed edge of the opening, and an inner wall 52 abutting the inside surface 14. The outer wall 48, edge covering wall 50, an inner wall 52 are bent in a form of a U to snugly engage the thickness of the panel 22 in which the opening is formed. An inside edge of the inner wall 52 is bent outward toward the panel to form a hook 54 which engages a channel 56 formed along the opening to secure the opening molding 46 to the opening. In a preferred embodiment the leg 48 is biased inward to aid in holding the hook 54, into engagement with the channel 56.

Figure 10:
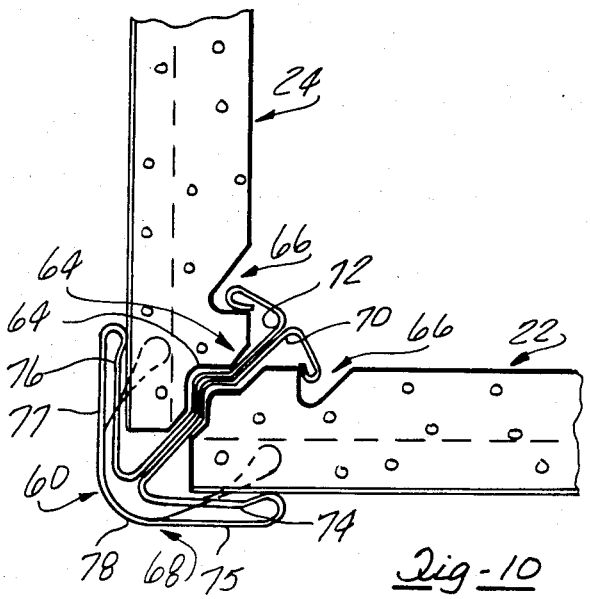
FIG. 10 illustrates a preferred embodiment of the corner joint which is a cross sectional view taken along the line 2—2 of FIG. 1.

FIG. 10 of the drawing illustrates a preferred embodiment of a corner joint 60 for joining the first upright wall 22 to the second upright wall 24 at a corner. The upright walls 22, 24 meet at a right angle along a corner at a 45 degree angled edge 62. A tongue and groove joint 64 is formed along the angled edge 62 to interlock the panels or walls 22, 24. A locking channel 66 is formed along an inside surface of the first and second upright wall 22, 24 spaced at a distance from the angled edge 62. A corner joining member 68 is provided which comprises a pair of opposed abutting inside legs 70, 72 extending outward in an opposed manner along the angled edge 62. An inner end of the inside legs curves outward then inward in an opposed manner to engage the locking channel 66. An outer end of each opposed inside leg 70, 72 curves outward at the corner in an opposed arcuate manner to form a pair of opposed corner legs 74, 76 which abut the metal sheeting of the first and second walls 22, 24. Each opposed corner leg 74, 76 at an outer end thereof curves outward then toward the corner in an arcuate manner to form a pair of opposed outside corner members 75, 77 which extend toward the corner parallel to the pair of opposed corner legs 74, 76 where they meet at an arcuate 78 formed at the corner where they are joined to form a continuous integral piece.

Figure 3:
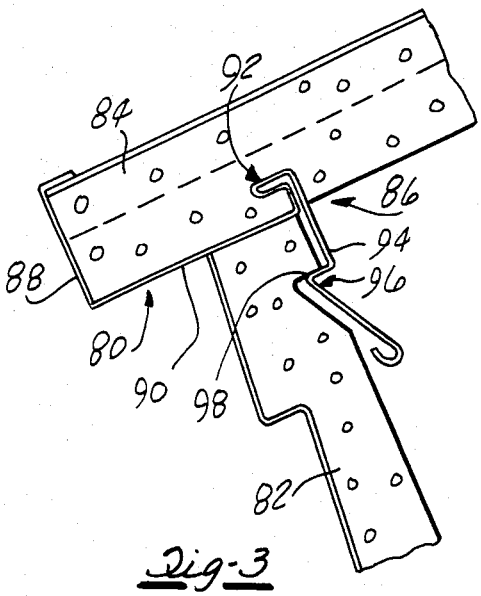
FIG. 3 illustrates a cross sectional view taken along the line 3—3 of FIG. 1.

As shown in FIG. 3 of the drawing, a gable joint 80 is provided to join an end wall of the building 82 and a roof panel 84. The gable joint 80 comprises a gable clip 86 including a U shaped end 88 to snugly cover the roof panel end and enclose the exposed polyurethane insulation. A lower portion of the clip 90 abuts the lower surface of the roof panel and extends inward a distance and upward then outward to form a hook 92 which is embedded in the roof panel to anchor the clip 86 to the roof. An end of the hook 92 is then bent upward then bent toward the ridge then downward abutting the hook forming a downward extension 94 extending downward a distance abutting the end wall 82. The downward extension 94 extends downward a distance abutting the end wall 82 then is bent outward toward the end wall then downward and inward to form a gable notch engaging extension 96. A gable notch 98 is formed along the gable edge to snugly engage the gable notch engaging extension and secure the roof panel 84 to the end wall 82.

Figure 4:
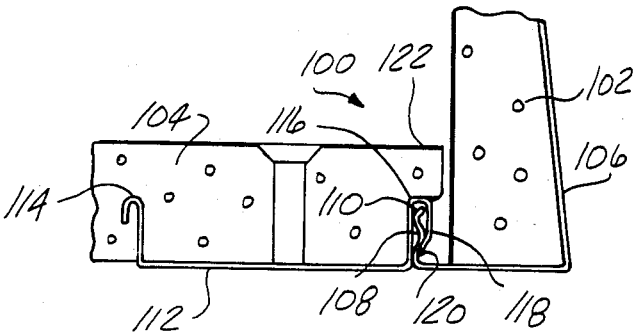
FIG. 4 illustrates a cross sectional view taken along the line 4—4 of FIG. 1.

FIG. 4 of the drawing illustrates at 100 a joint releaseably securing a first wall 102 to a second wall 104 in a secure manner. As illustrated in FIG. 4, the joint 100 is used to secure the floor of the modular building to the side walls. However, it would be readily apparent to the skilled artisan that the joint 100 can be employed to join any pair of panels. The joint 100 comprises a layer of metal sheeting 106 covering the outer surface of the first wall 102. The sheeting 106 is wrapped around an end of the wall and projects inward a distance then upward then upward and outward, then upward and inward to form a zig-zag 108. The zig-zag is terminated at an outwardly curled arcuate 110. The second wall 104 includes a metal strip 112 abutting a lower surface of the wall 104 adjacent the first wall 102. An inner end of the metal strip 112 is bent upward then curved to form a hook end 114 which is embedded in the second wall 104. An outer end of the metal strip 112 is bent upward abutting an end of the second wall 112 then bent arcuately outward forming an inverted U. An outer leg 118 of the inverted U 116 is bent downward and inward to abut a lower portion of the zig-zag 108. The outer leg 118 terminates at a curled out arcuate 120. A projection 122 of the second wall 104 overlays the zig-zag 108 and abuts the first wall 102 to enclose the joint 100. The first wall 102 and the second wall 104 are releaseably joined by snapping the outwardly curled arcuate 120 over the zig-zag 108.

Figure 5:
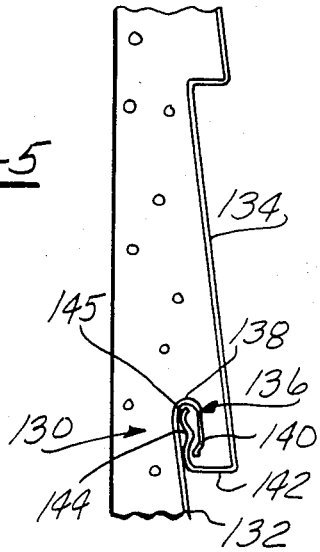
FIG. 5 illustrates a cross sectional view taken along line 5—5 in FIG. 1.

FIG. 5 of the drawing illustrates at 130 a joint for joining a first sheet metal panel 132 and a second sheet metal panel 134 in a releasable manner. The first sheet metal panel 132 includes an upper end 136 curled outward in an arcuate manner then extending downward spaced from the panel forming an inverted U 138. An outer leg of the inverted U 140 extends downward and inward a distance and curls outward at an end thereof. The second sheet metal panel 134 includes a lower end 142 bent to extend inward a distance then bent to extend upward and outward a distance then bent to extend upward and inward a distance defining a zig-zag 144 which terminates at an outward extending arcuate curl 145. The first sheet metal panel 132 is releasably joined to the second sheet metal panel 134 by snapping the lower end of the second sheet metal panel into the inverted U of the first sheet metal panel with the arcuate curl 145 abutting the curled outward portion of the inverted U 138.

Figure 7:
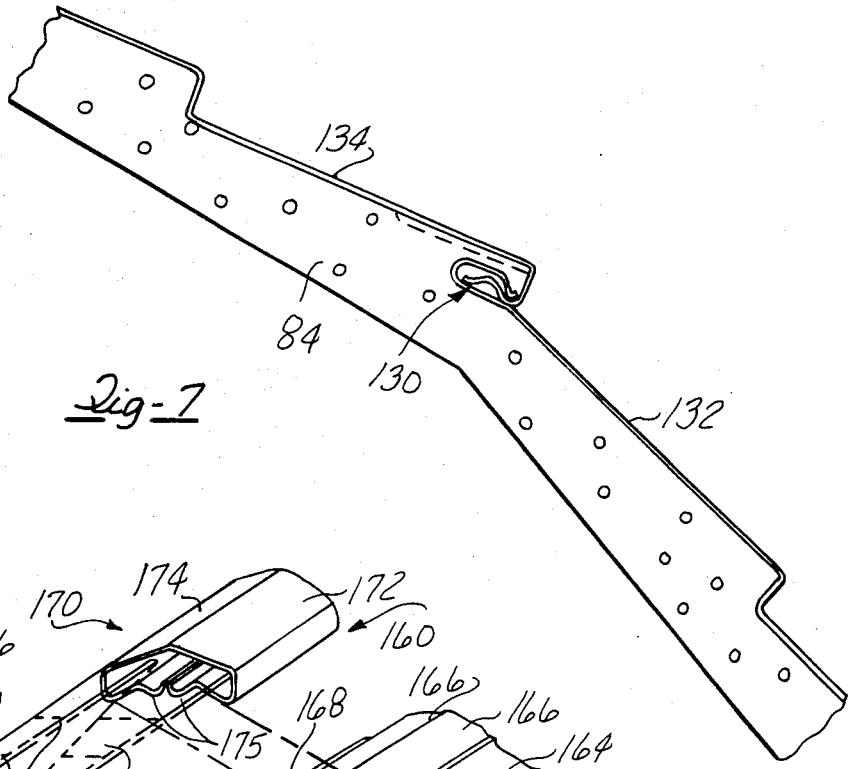
FIG. 7 illustrates a cross sectional view taken along the line 7—7 of FIG. 1.

FIG. 7 of the drawing illustrates how the joint 130 as described hereinabove may be used to secure the metal sheeting 132, 134 of a roof panel 84.

Figure 11:
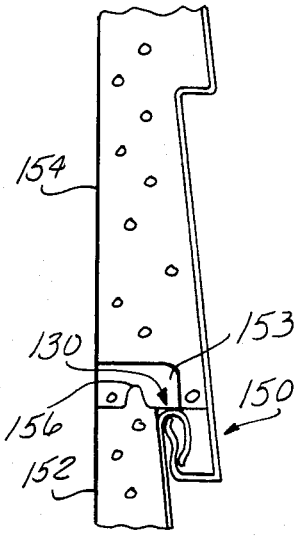
FIG. 11 illustrates an embodiment of the side wall taken along line FIG. 5—5 in FIG. 1 wherein the foam panel is provided with a tongue and groove joint.

FIG. 11 of the drawing illustrates at 150 the joint 130 employed to secure in abutment a pair of sheet metal clad insulated panels 152, 154. An insert 153 placed between panels provides convenience in molding and assembling the panels. A tongue and groove joint 156 is employed to interlock the panels 152, 154.

Figure 8:
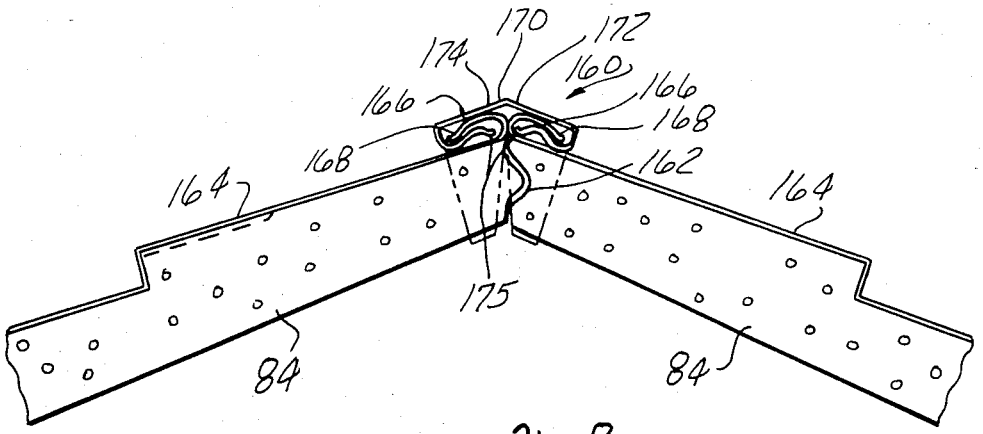
FIG. 8 illustrates a cross sectional view taken along the line 8—8 of FIG. 1.
Figure 9:
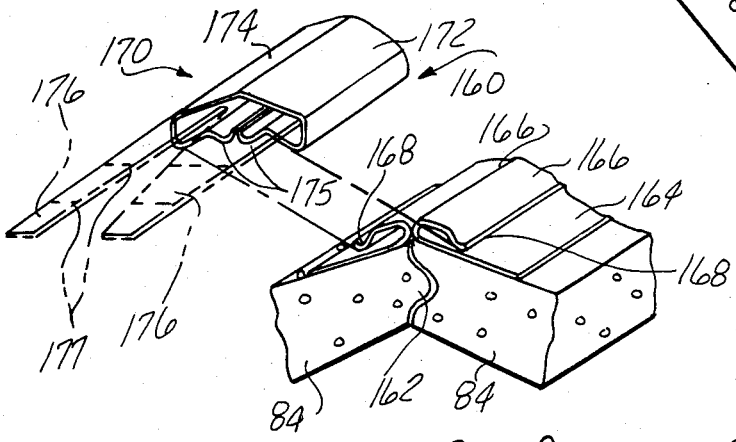
FIG. 9 illustrates a broken cross sectional exploded view of the ridge portion of FIG. 8.

FIGS. 8 and 9 of the drawing illustrate at 160 a ridge joint for joining roof panels at the ridge or peak of the roof. The roof panels 84 abut at the ridge along a tongue and groove joint 162 which holds the abutting panels 84 in interlocking engagement. The panels 84 are overlayed with a metal sheeting 164 which extends past the abutting ends a distance to form an extending end 166. The extending end 166 of each metal sheeting extends to the ridge and is then curved upward then outward in an opposed arcuate manner. The extending end extends outward a distance spaced above the roof panel and is then bent downward and outward toward the roof panel terminating with a first upward arcuate curl 168. The ridge joint 160 further includes a ridge member 170 comprising a pair of opposed top panels 172 174 extending downward and outward in an opposed manner spaced above the roof panel and covering the ridge and extending ends 166. An outer end of the top panel 172 174 curves downward then inward embracing the first arcuate curl 168. The ridge member then extends upward an inward a distance and then downward and inward a distance to terminate at a second arcuate curl 175. To assemble the roof panel 84 at the ridge, the ridge member 170 is slid over the extending ends 166 to secure the pair of roof panels 84 in abutment. Each opposed top panel 172 174 includes a pair of extending legs 176 which extend past an end of the roof panel along a line of the ridge. Each leg 176, after the ridge member 170 is slid into place, is folded down along fold lines 177 to cover the abutting ridge ends.

Figure 6:
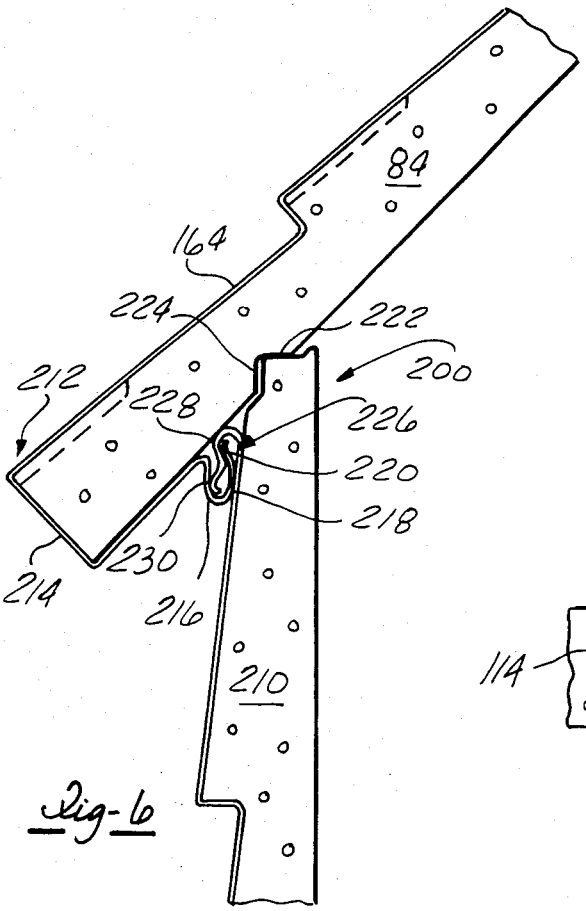
FIG. 6 illustrates a cross sectional view taken along the line 6—6 of FIG. 1.

FIG. 6 of the drawing illustrates at 200 a joint for releaseably assembling the roof panel 84 at a lower end thereof to the wall 210. The roof panel 84 includes a lower end overhang 212 which extends past the wall 210 a distance. An extending end 214 of the roof panel is bent downward then inward to cover the roof panel edge and an outward portion of the roof panel lower surface. An inward edge of the extending end 214 is bent downward then curved inward then upward to form a U 216. An inward leg of the U 218 extends outward an upward a distance and terminates at an inward arcuate curl 220. The wall 210 includes an upper edge 222 abutting a notch 224 formed along a lower surface of the roof panel 84. An extending end of the wall 226 is curved outward then downward forming an inverted U positioned downward from the upper edge 222. An outer leg 228 of the inverted U extends inward and downward a distance to abut the inward leg 218 of the U. The outward leg 228 then extends downward and inward a distance terminating at an inward curling arcuate 230 which abuts the inward curve of the U 216. The roof panel 84 and the wall 210 are releaseably assembled by snapping the U 216 into the inverted U.

The wall and roof panels described above are preferably made from polyurethane foam utilizing a well-known injection molding process. The metal sheeting is preferably made from 0.019 inches thick aluminum which has been painted before assembly to the panels. The surface of the injection molding mold which forms the panel and defines the interior surface of the panels is contoured to resemble a wood grain surface which produces a beautiful wood grained affect for the interior of the modular building. The polyurethane foam may be colored to further inhance the wood grained effect and add to the beauty of the building interior. Foam is produced in the mold by adding a blowing agent such as nitrogen to the polyurethane as it is heated and injected into the mold in a well known manner.

The preferred method making the modular building panels comprises the steps of:

forming an exterior surface from sheet metal, the exterior surface having projecting edges;

Installing the exterior surface in a mold, the mold including a lower cavity with a surface complimentary to and abutting the surface of the exterior surface. The decorative surface and an exterior dimension complimentary to the size of the panel to be formed allowing the projecting ends to extend beyond the panel;

Closing the mold;

Injecting heated polyurethane and a blowing agent into the mold to fill the space between the upper and lower cavities with foam;

allowing the foam to solidify and removing the panel from the mold; and roll forming a joint for releaseably connecting panels along the projecting edge.

It can thus be seen that the present invention has provided a new and improved modular builiding that is economical to build, well insulated, pleasing in appearance, and durable.

It should be understood by those skilled in the art of modular buildings that other forms of applicant's invention may be had, all coming within the spirit of the invention and the scope of the appended claims.

Having thus described my invention what I claim is:

1. A modular builiding having wall panels and roof panels formed of an insulating material; a surface of said wall panels and roof panels covered with metal sheeting; an extending edge of each panel formed into a corner joint; said corner joint cooperating with adjacent panel for joining a first upright wall and a second upright wall at a corner comprising:

the first and second upright walls abutting at a right angle at a corner along an abutting edge;

the abutting edge having a forty five degree angle;

a tongue and groove joint formed along the abutting edge;

a corner clip comprising a first leg abutting the first upright wall and extending to the corner, a first inner leg formed by bending the first leg inward abutting the abutting edge, the first inner leg passing over the tongue and groove joint in a complimentary manner, the first inner leg then being bent outward to engage the first upright wall and then being bent inward to form a first notch engaging extension, a first notch formed along the first upright wall to snugly receive the first notch engaging extension, a cross over segment formed by bending an inner end of the first notch engaging extension toward the second upright wall, a second notch engaging extension which is a mirror image of said first notch engaging extension formed by bending an end of the cross over segment toward the corner then inward, a second notch formed along said second upright to receive the second notch engaging extension, an inner end of the second notch engaging extension bent to extend outward forming a second inner leg abutting the first inner leg, an outer end of the second inner leg is then bent to form a second leg abutting second upright wall; and the first leg biased inward toward the first upright wall, the second leg biased inward toward the second wall to hold the first and second walls in abutment.

* * * * *